US009051839B2

(12) United States Patent
Senoo

(10) Patent No.: US 9,051,839 B2
(45) Date of Patent: Jun. 9, 2015

(54) SUPERSONIC TURBINE MOVING BLADE AND AXIAL-FLOW TURBINE

(75) Inventor: Shigeki Senoo, Hitachi (JP)

(73) Assignee: Mitsubishi Hitachi Power Systems, Ltd., Kanagawa (JP)

( * ) Notice: Subject to any disclaimer, the term of this patent is extended or adjusted under 35 U.S.C. 154(b) by 546 days.

(21) Appl. No.: 13/536,105

(22) Filed: Jun. 28, 2012

(65) Prior Publication Data

US 2013/0004302 A1 Jan. 3, 2013

(30) Foreign Application Priority Data

Jun. 29, 2011 (JP) ..... 2011-143987
May 31, 2012 (JP) ..... 2012-124897

(51) Int. Cl.
*F01D 5/14* (2006.01)

(52) U.S. Cl.
CPC ..... *F01D 5/141* (2013.01); *F05D 2240/302* (2013.01); *F05D 2240/303* (2013.01); *F05D 2240/304* (2013.01); *F05D 2240/305* (2013.01); *F05D 2240/306* (2013.01); *F01D 5/145* (2013.01)

(58) Field of Classification Search
CPC ..... F01D 5/141; F05D 2240/302; F05D 2240/304; F05D 2240/305; F05D 2240/306
USPC ..... 415/181; 416/241 R
See application file for complete search history.

(56) References Cited

U.S. PATENT DOCUMENTS 2,974,927 A * 3/1961 Johnson ..... 415/181
3,156,407 A * 11/1964 Bourquard ..... 415/181
3,442,441 A * 5/1969 Dettmering ..... 415/193
4,080,102 A 3/1978 Schwab
4,123,196 A * 10/1978 Prince et al. ..... 415/181
5,267,834 A 12/1993 Dinh et al.
2006/0222490 A1 10/2006 Senoo et al.
2007/0025845 A1 2/2007 Senoo et al.

FOREIGN PATENT DOCUMENTS

CN 1840857 A 10/2006
CN 201507325 U 6/2010
JP 2006-307843 A 11/2006
JP 2007-127132 A 5/2007
JP 2011-99380 A 5/2011

OTHER PUBLICATIONS

Chinese Office Action (201210219951.9) dated Mar. 31, 2014 (six pages).

* cited by examiner

*Primary Examiner* — Ninh H Nguyen
(74) *Attorney, Agent, or Firm* — Crowell & Moring LLP

(57) ABSTRACT

A supersonic turbine moving blade in which increased circumferential speed due to increased blade length and average diameter reduces shock wave loss in its inflow area. It has at least one of the following features: pressure surface curvature is nonnegative from the leading to trailing edge end; negative pressure surface curvature is positive upstream and negative downstream; dimensionless pressure surface curvature (inter-blade pitch divided by curvature radius) is larger than 0.0 and smaller than 0.1 in the 30%-to-60% portion of the length along the pressure surface; the leading edge part is formed by continuous curvature curves and the distance between ½ point of the blade maximum thickness and leading edge end exceeds ½ of the maximum thickness; the exit angle is larger than a theoretical outflow angle; and the maximum thickness point is nearer to the trailing edge than to the leading edge.

31 Claims, 12 Drawing Sheets

SUPERSONIC TURBINE MOVING BLADE AND AXIAL-FLOW TURBINE

CLAIM OF PRIORITY

The present application claims priority from Japanese Patent applications serial No. 2011-143987, filed on Jun. 29, 2011 and No. 2012-124897, filed on May 31, 2012, the respective contents of which are hereby incorporated by reference into this application.

TECHNICAL FIELD

The present invention relates to turbine moving blades and axial-flow turbines and more particularly to supersonic turbine blade airfoil applied to the tip side of turbine moving blades used in steam turbines, etc.

BACKGROUND ART

Axial-flow turbines have a function to convert the kinetic energy which is generated as a high-pressure fluid expands toward a low-pressure area, into a turning force by stages comprised of stationary blades and moving blades. In axial-flow turbines, in order to increase work output per stage, it is desirable to increase the flow rate as the mass of a fluid flowing per unit time. If work output per stage is increased, production of electricity can be increased without altering the number of stages in the case of multi-stage turbines such as steam turbines for power generation.

In order to increase the flow rate, it is useful to increase the annular band area as the area of a fluid flow zone as seen from the rotation axis. For axial-flow turbines, the annular band area is calculated as follows: the average diameter obtained by dividing the sum of blade outer peripheral end diameter and inner peripheral end diameter by 2 is multiplied by blade length and the product is multiplied by the circle ratio. Therefore, in the case of axial-flow turbines, in order to increase the annular band area, the blade length and average diameter are increased.

If the blade length or average diameter is increased, the moving blade tip circumferential speed increases and the relative velocity at fluid inflow to the moving blade becomes supersonic, which may cause shock wave loss in the inflow area of the moving blade.

In the past, a technique to reduce shock wave loss in the moving blade inflow area due to a lengthened turbine moving blade as described in PTL 1 has been proposed in which the shape of the annular outer peripheral portion of the stationary blade is designed so as to prevent the velocity of a fluid flowing to the moving blade relative to the moving blade from exceeding sonic velocity.

CITATION LIST

Patent Literature

[PTL 1] Japanese Patent Laid-Open No. 2006-307843 (Corresponds to US2007/0025845A1)

SUMMARY OF INVENTION

Technical Problem

In the technique described in PTL 1, the shape of the annular outer peripheral portion of the stationary blade is designed so as to prevent the velocity of a fluid flowing to the moving blade relative to the moving blade from exceeding sonic speed, thereby suppressing shock wave loss in the inflow area of the moving blade. However, when the length of the turbine moving blade is further increased, it is difficult to suppress shock wave loss simply by the shape of the stationary blade annular outer peripheral portion.

Generally, specific total enthalpy H0 at the stage entrance, which is the sum of enthalpy per unit mass (specific enthalpy) and kinetic energy per unit mass calculated by dividing squared flow velocity by 2, is considered to be almost constant from the inner peripheral side near to the rotation axis toward the outer peripheral side. On the other hand, specific enthalpy h1 between the stationary blade and moving blade is larger on the outer peripheral side than on the inner peripheral side so as to balance with the swirl flow between the stationary and moving blades. Therefore, specific enthalpy difference H0−h1 is smaller on the outer peripheral side. The velocity of the flow from the stationary blade is proportional to the square root of specific enthalpy difference H0−h1. In other words, the stationary blade outflow velocity is smaller on the outer peripheral side.

As described above in the "Background Art" section, as the annular band area is increased, or the blade length or average diameter is increased, specific enthalpy difference H0−h1 on the outer peripheral side will be smaller and the stationary blade outflow velocity will be lower. It is thus understood that as the annular band area is increased, specific enthalpy difference H0−h1 on the outer peripheral side and the stationary blade outflow velocity decrease. On the other hand, the moving blade circumferential speed increases in proportion to radius. This fact may cause a problem described below.

The problem is that it becomes more likely that the relative inflow Mach number of the moving blade becomes supersonic and loss increases. As the blade length or average diameter is larger, the circumferential speed as the moving blade rotation speed is higher. The circumferential speed of the moving blade is the highest at the outer peripheral end where the radius it the largest, namely the moving blade tip. As the circumferential speed Mach number calculated by dividing the circumferential speed at the tip by sonic velocity exceeds 1 or becomes supersonic, the velocity of flow to the moving blade relative to the moving blade (moving blade relative inflow velocity) may become supersonic if the rotational direction component of the flow from the stationary blade is not sufficient. At the larger radius position, the circumferential speed is higher and the stationary blade outflow velocity is smaller. Therefore, at a given radius position (blade height) or higher, the moving blade circumferential speed becomes dominant and the moving blade relative inflow velocity becomes supersonic. As the moving blade relative inflow velocity becomes supersonic, a shock wave which involves a discontinuous pressure rise occurs on the upstream side of the moving blade. In addition to an entropy rise due to the shock wave, interference of the shock wave with a blade surface boundary layer occurs, which causes an increase in the boundary layer thickness due to the discontinuous pressure rise. Furthermore, an entropy rise occurs due to peeling, etc. It may happen that although the turbine stage annular band area is increased and the flow rate of working fluid is increased, the turning force corresponding to the increased flow rate, or work output, may not increase due to the entropy rise caused by the shock wave. Therefore, in order to increase work output per stage by increasing the annular band area beyond a circumferential speed limit (moving blade circumferential speed at which the moving blade relative inflow velocity becomes supersonic), it is important to weaken the shock wave which occurs in the moving blade inflow area.

At the blade height at which the moving blade relative inflow velocity becomes supersonic, the specific enthalpy drop of the moving blade is large, so the velocity of outflow from the moving blade relative to the moving blade (moving blade relative outflow velocity) also becomes supersonic.

A turbine blade airfoil in which the velocity is supersonic at both inflow and outflow like this is called "supersonic turbine blade airfoil." Also, a turbine moving blade which has a supersonic turbine blade airfoil at a given blade height or more is called "supersonic turbine moving blade." In a supersonic turbine blade airfoil in which both the moving blade relative inflow velocity and moving blade relative outflow velocity are supersonic, shock wave loss may be generated even in an area other than the moving blade inflow area. In the related techniques including the technique described in JP-A-2006-307843, no consideration is given to reduction of shock wave loss in the supersonic turbine blade airfoil.

As described in detail later in the "Description of Embodiments" section, a supersonic turbine moving blade features such a blade shape that the blade exit angle is oriented in the axial direction of the turbine with respect to the blade entrance angle. Specifically, in a supersonic turbine moving blade according to the present invention, a high pressure area is on the upstream side and a low pressure area is on the downstream side and a flow expands in a flow passage between neighboring blades and (1) the blade exit angle is oriented in the axial direction of the turbine with respect to the blade entrance angle or (2) both the inflow Mach number and outflow Mach number exceed 1.0 and the inflow and outflow velocities are supersonic.

An object of the present invention is to provide a supersonic turbine moving blade which can reduce shock wave loss in a moving blade inflow area, etc.

Solution to Problem

According to a first aspect of the present invention, there is provided a supersonic turbine moving blade in which, when a blade surface curvature with a curvature center in an inner direction of the blade is defined as positive, at least one of the following features is provided: (1) a blade pressure surface curvature is positive or zero from the leading edge end to the trailing edge end, (2) a blade negative pressure surface curvature is positive on the upstream side and negative on the downstream side with an inflexion point midway where the curvature is zero, and (3) a dimensionless blade pressure surface curvature calculated by dividing the pitch as a distance between blades in the circumferential direction by the curvature radius as the reciprocal of blade pressure surface curvature is larger than 0.0 and smaller than 0.1 in the 30% to 60% portion of the entire length in a distance along the blade pressure surface.

According to a second aspect of the present invention, there is provided a supersonic turbine moving blade having a blade leading edge part formed by continuous curvature curves, in which (1) the distance between a point with one half of the maximum thickness of the blade on the upstream side of the blade and an end of the blade leading edge is larger than one half of the maximum thickness of the blade or (2) the angle of a blade negative pressure surface tangent with respect to the entrance angle direction and the angle of a blade pressure surface tangent with respect to the entrance angle direction at a point with one fifth of the maximum thickness of the blade on the upstream side of the blade are both 20 degrees or less.

According to a third aspect of the present invention, there is provided a supersonic turbine moving blade in which the exit angle of the blade is larger than a theoretical outflow angle or a point with the maximum thickness of the blade is nearer to the blade trailing edge than to the blade leading edge and the flow passage between blades is an expanded flow passage with a throat as an entrance.

Advantageous Effects of Invention

According to the present invention, in an axial-flow turbine, even when the annular band area is increased by increasing the blade length or average diameter, shock wave generated in the inflow area of the moving blade can be weakened. As a consequence, the circumferential speed of the moving blade becomes higher, resulting in reduction of shock wave loss in the inflow area of the moving blade and improvement of turbine efficiency, which leads to larger work output under the same steam conditions. In addition, the present invention can offer more advantageous effects by a combination of the above various features.

The above and further features and advantages of the invention will more fully appear from the following detailed description of preferred embodiments.

DESCRIPTION OF EMBODIMENTS

Next, the preferred embodiments of the present invention will be described by taking the final stage of a steam turbine as an example. However, the advantageous effects of the present invention are not limited to the final stage. Specifically the invention is particularly effective when the circumferential speed of the moving blade tip exceeds a circumferential speed limit at a stage previous to the final stage. The invention also reduces shock wave loss regardless of the type of working fluid (steam, air, etc.).

First, an example of an axial-flow turbine (steam turbine) according to the present invention will be described referring to FIG. 1.

Figure 1:
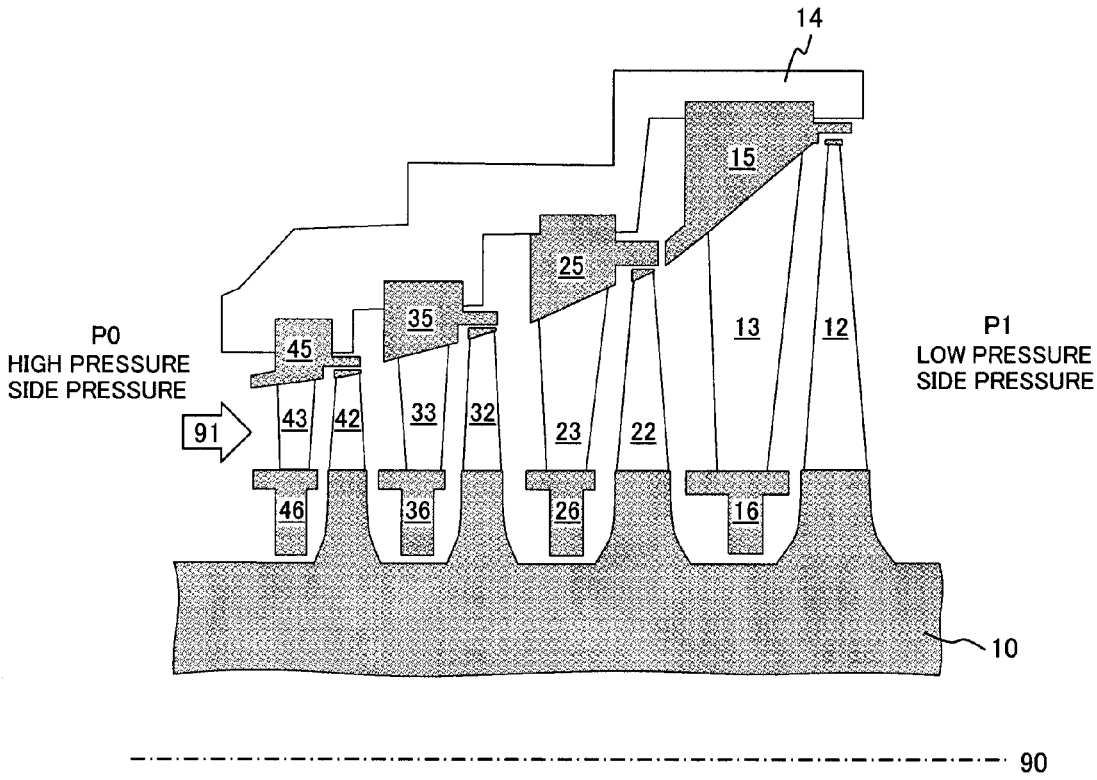
FIG. 1 is a meridian sectional view of an axial-flow turbine according to the present invention which illustrates the basic structure of turbine stages of the axial-flow turbine.

As illustrated in FIG. 1, the turbine stages of an axial-flow turbine are located between a high pressure area P0 on the upstream side in the working fluid flow direction (hereinafter simply referred to as the upstream side) and a low pressure area P1 on the downstream side in the working fluid flow direction (hereinafter simply referred to as the downstream side). The final turbine stage includes a stationary blade 13 fixed between an outer peripheral diaphragm 15 fixed on the inner periphery of a turbine casing 14, and an inner peripheral diaphragm 16, and a moving blade 12 provided on a turbine rotor 10 which turns around a turbine center axis 90. In an axial-flow turbine which includes a plurality of turbine stages, this stage structure is provided repeatedly several times in the working fluid flow direction. FIG. 1 illustrates that the turbine has a stage comprised of an outer peripheral diaphragm 25, an inner peripheral diaphragm 26, a stationary blade 23, and a moving blade 22, a stage comprised of an outer peripheral diaphragm 35, an inner peripheral diaphragm 36, a stationary blade 33, and a moving blade 32, and a stage comprised of an outer peripheral diaphragm 45, an inner peripheral diaphragm 46, a stationary blade 43, and a moving blade 42. In each stage, a moving blade is located on the downstream of a stationary blade, opposite to the moving blade.

Figure 2:
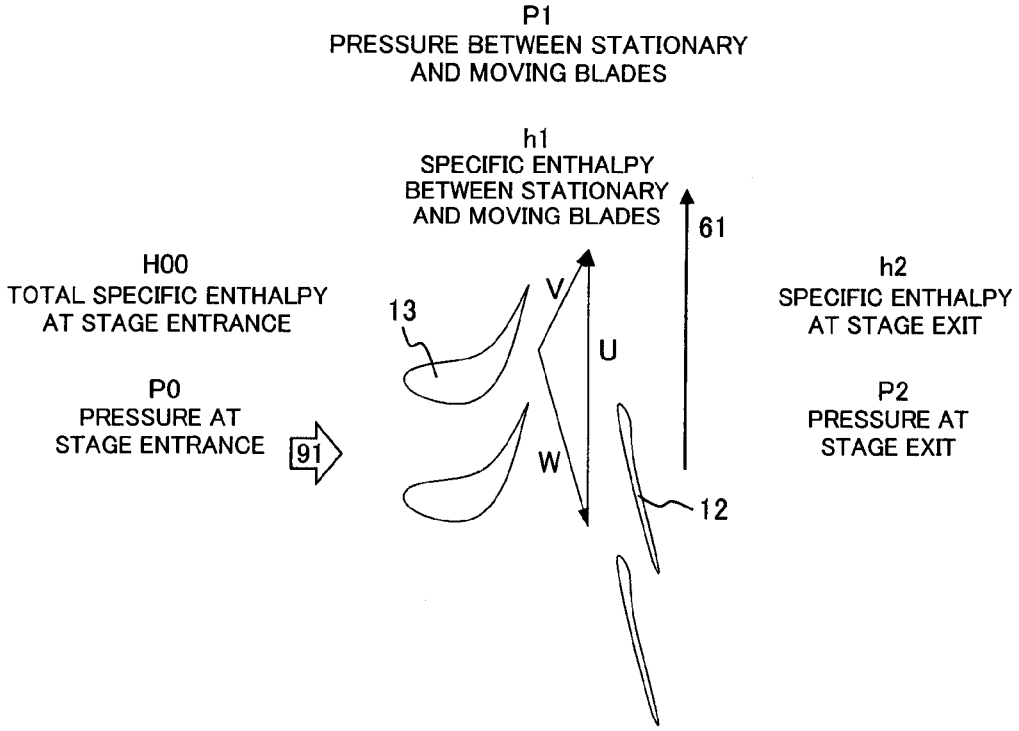
FIG. 2 schematically illustrates the relation among a flow from a stationary blade, moving blade circumferential speed, and moving blade relative inflow velocity.

FIG. 2 schematically illustrates the relation among a flow from the stationary blade, moving blade circumferential speed, and moving blade relative inflow velocity. When the blade length and average radius are larger, the radius at the outer peripheral end is larger so the moving blade circumferential speed is higher. This figure schematically illustrates a general velocity triangle between stationary and moving blades. High pressure P0 steam 91 is accelerated and turned by the stationary blade 13 to become a flow with velocity V. When the flow V is seen in a relative coordinate system which rotates with the moving blade 12, the moving blade 12 rotates in direction 61 at circumferential speed U and as illustrated in FIG. 2, the moving blade relative inflow velocity becomes flow velocity W as a result of combination of vector V and vector U. The triangle which is comprised of vector V, vector U, and vector W is called "velocity triangle." As can be understood from the velocity triangle, when the moving blade circumferential speed U increases, the relative flow velocity W of the fluid flow to the moving blade increases and the inflow relative Mach number may exceed 1.0, resulting in a supersonic inflow. Furthermore, the blade outflow relative Mach number may exceed 1.0, resulting in a supersonic outflow. The reason for this is that as the blade length is larger, the influence of the tangential velocity field is stronger and the specific enthalpy h1 between stationary and moving blades is larger on the outer peripheral side due to the tangential velocity field at the stationary blade exit. The enthalpy at the relative field stagnation point is h1 plus kinetic energy $w^2/2$. Therefore, the heat drop for the moving blade is as large as $h1+w^2/2-h2$ and the outflow relative Mach number exceeds 1.0, resulting in a supersonic outflow.

Figure 3:
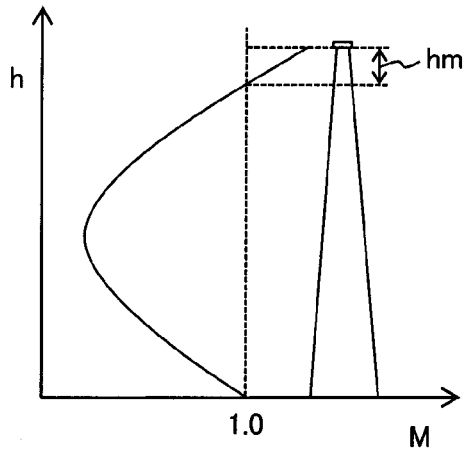
FIG. 3 illustrates the range within which a turbine moving blade airfoil according to an embodiment of the present invention can be applied, conceptually illustrating the velocity of inflow to the moving blade.

The velocity of inflow to the moving blade differs according to the height of the moving blade as illustrated in FIG. 3. FIG. 3 is a graph conceptually illustrating the velocity of inflow to the moving blade, in which the vertical axis represents moving blade height and the horizontal axis represent Mach number. In this embodiment, the present invention is applied to a blade airfoil in which the Mach number of velocity of inflow to the moving blade exceeds 1.0, namely a blade mode within the range indicated by hm in the graph.

Based on the above discussion, a supersonic turbine moving blade according to an embodiment of the present invention will be described in detail below.

Figure 4:
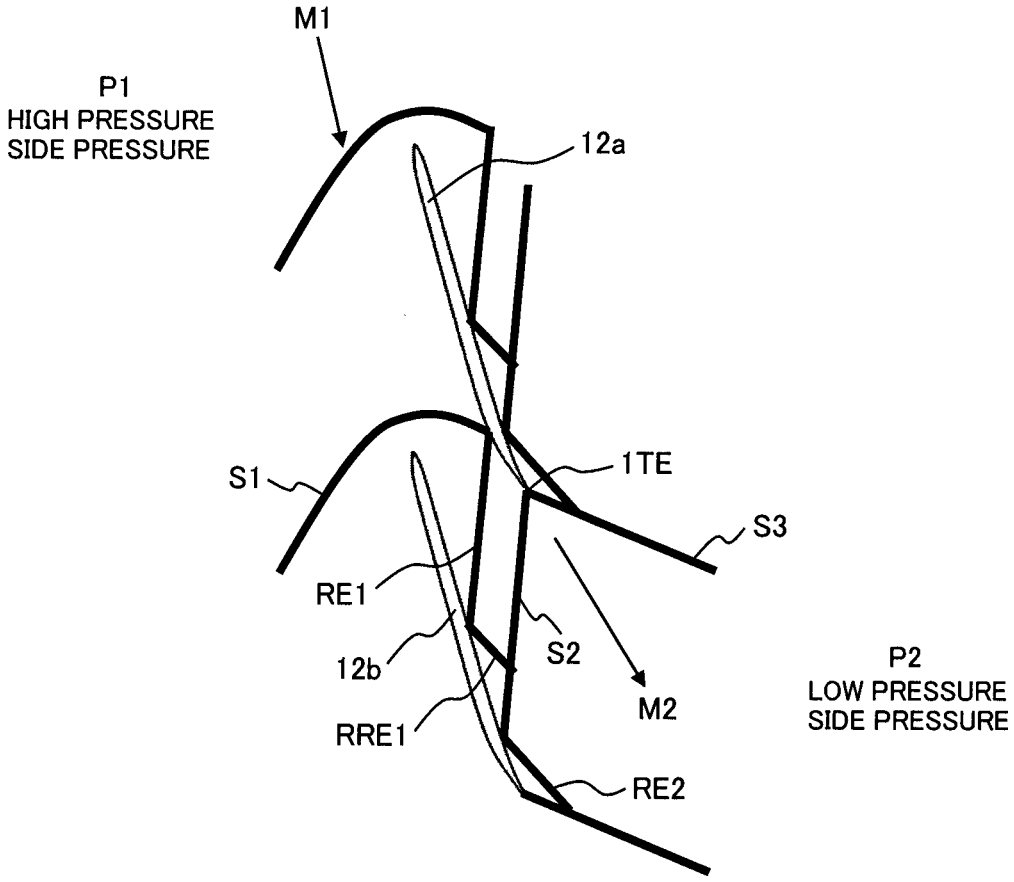
FIG. 4 illustrates the characteristics of a flow field in a turbine moving blade according to the present invention in the case that inflow velocity and outflow velocity are both supersonic.

FIG. 4, which illustrates the characteristics of a flow field in the turbine moving blade, is a schematic diagram of shock wave generated in the flow field in the case that the inflow velocity M1 and outflow velocity M2 are both supersonic. Since the supersonic flow is intercepted by the moving blade 12*b*, shock wave S1 is generated on the upstream side. The shock wave S1 is reflected as RE1 by the pressure surface of the moving blade 12*a* opposite to it and further reflected as RRE1 by the negative pressure surface of the moving blade 12*b*. At blade trailing edge end 1TE, since the fluid flow turns around the trailing edge (trailing edge part), it is bent, generating shock wave S2 and shock wave S3. The shock wave S2 is reflected as RE2 by the negative pressure surface of the moving blade 12*b* opposite to it. Since these shock waves cause an increase in loss, the embodiments of the present invention are intended to decrease the intensity of these shock waves.

Figure 5:
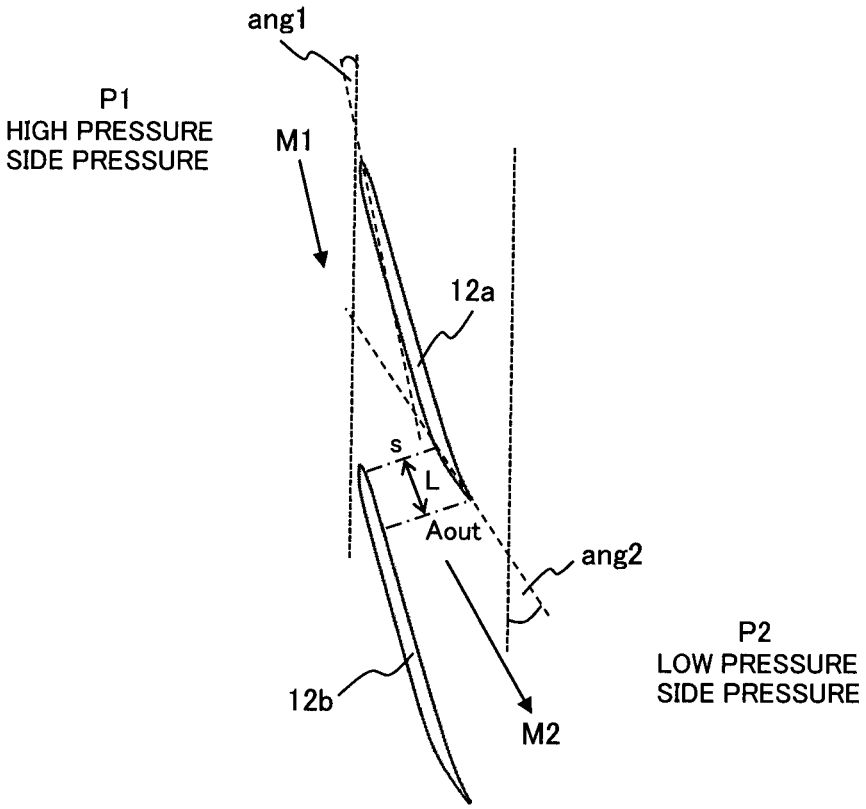
FIG. 5 illustrates a cross section of a turbine moving blade airfoil according to an embodiment of the present invention.

FIG. 5 illustrates the essential structure of a turbine moving blade according to an embodiment of the present invention (cross section of the turbine moving blade). As a subsonic flow expands, the flow passage area becomes smaller, so in an ordinary turbine blade, the blade exit angle is inclined in the circumferential direction with respect to the blade entrance angle. In an ordinary turbine blade, the flow passage between blades is designed so that the flow passage area once shrinks and then expands. On the other hand, a supersonic flow tends to expand the flow passage area during expansion. In this embodiment, therefore, in order to ensure that a supersonic flow is smoothly accelerated when the inflow velocity M1 and outflow velocity M2 are both supersonic, the turbine blade shape is designed so that the blade exit angle ang2 is larger than the blade entrance angle ang1, namely the blade exit angle ang2 is inclined in the turbine axial direction with respect to the blade entrance angle ang1. In other words, this structure may be said to be based on an interpretation of a supersonic inflow and a supersonic outflow in a structural aspect. In this embodiment, the flow passage between the moving blades 12*a* and 12*b* is an expanded flow passage with a throat as an entrance, which enables a supersonic flow to be smoothly accelerated. Consequently, the shock wave S2 at the trailing edge caused by the blade pressure surface and shock wave S3 at the trailing edge caused by the blade negative pressure surface as illustrated in FIG. 4 are weakened. This mechanism will be described later along with other features, referring to FIGS. 10 and 11.

When the present invention is applied to a turbine blade with a large blade length, the cross-sectional area must be decreased to reduce the centrifugal force. Specifically, in order to form an expanded flow passage and decrease the cross-sectional area, it is desirable to decrease distance L between the minimum inter-blade flow passage width part s and the inter-blade flow passage exit Aout as illustrated in FIG. 5 and increase flow passage width ratio Aout/s.

In order to achieve this, it is desirable that the blade exit angle ang2 be larger than the theoretical outflow angle ang2*t* expressed by Equation (1). Equation (1) is a formula to calculate a theoretical outflow angle ang2*t* upon isentropic expansion. In Equation (1), blade entrance angle ang1 (basically equal to inflow entrance angle) and inflow Mach number M1 are design variables which are determined in the upstream design phase. γ represents ratio of specific heat. Outflow Mach number M2 is calculated as an is entropic outflow Mach number from the pressure ratio (P2/P1) as a design variable determined in the upstream design phase, using a hypothesis of ideal gas. If the outflow Mach number Ms is in the range of 2.0 to 2.2, the extent to which the blade exit angle ang2 is larger than the theoretical outflow angle ang2*t* is desirably in the range of 5 to 15 degrees, though it depends on the magnitude of the outflow Mach number M2.

This makes it possible to decrease the distance L and form an expanded flow passage between blades according to outflow Mach number M2. Consequently not only shock wave loss at the trailing edge can be reduced but also blade centrifugal stress can be decreased. Since the distance L is decreased and an expanded flow passage is formed between blades, the maximum-width portion of the blade is nearer to the blade trailing edge 1TE than to the blade leading edge 1LE. In an ordinary turbine blade, the maximum-width portion of the blade is nearer to the blade leading edge 1LE unlike this embodiment. In other words, as compared with the ordinary turbine blade, this structure is novel in that an expanded flow passage is formed with the maximum-width portion of the blade nearer to the blade trailing edge 1TE than to the blade leading edge 1LE.

Equation 1

$$ang2t = \arcsin\left[\sin(ang1)\frac{M1}{M2}\left(\frac{1+\frac{\gamma-1}{2}M2^2}{1+\frac{\gamma-1}{2}M1^2}\right)^{\frac{\gamma+1}{2(\gamma-1)}}\right] \quad (1)$$

Figure 6:
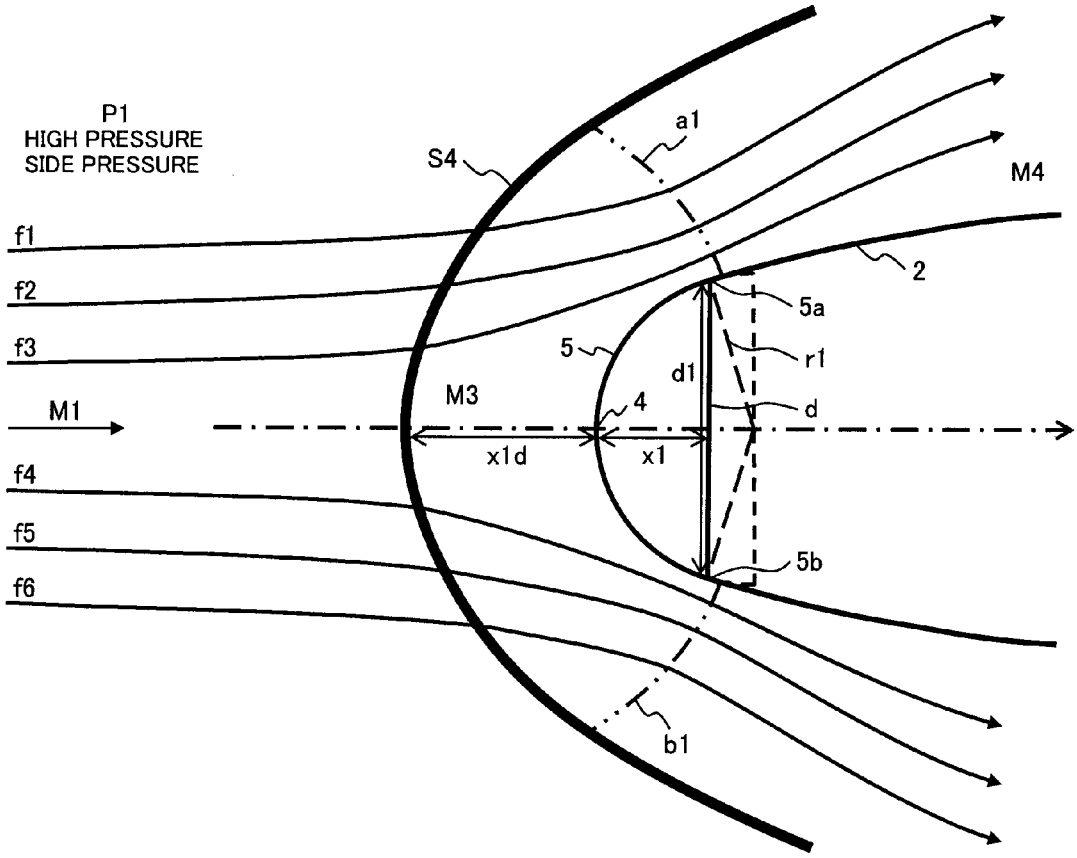
FIG. 6 illustrates the characteristics of a flow field in the case that a supersonic flow comes to a turbine moving blade with an arc-shaped leading edge.

Next, the shape of the blade leading edge (blade leading edge part) will be described. A commonly used turbine moving blade has an arc-shaped leading edge. FIG. 6 illustrates the characteristics of a flow field in the case that a turbine moving blade 2 with an arc-shaped blade leading edge 5 is placed in a supersonic inflow M1. The direction of the blade entrance angle is indicated as the horizontal direction. The leading edge arc-shaped portion with radius r1 begins at 5*a* and passes through the leading edge end 4 and ends at 5*b*. In the case of an arc-shaped leading edge, distance x1 between the leading edge end 4 and line segment d is always smaller than length d1 of the line segment d which connects 5*a* and 5*b*. Specifically, flows f1, f2, f3, f4, f5, and f6 sharply curve in the vicinity of the leading edge to avoid the blade. A supersonic flow can remain supersonic when it curves as far as the curving angle does not exceed a maximum angle δ max. If it curves at an angle in excess of that angle, the flow is decelerated to the subsonic level. After that, the flow becomes a supersonic flow M4 at sonic lines a1 and b1. When the flow is decelerated to the subsonic level, shock wave S4 (shock wave S1 illustrated in FIG. 4) is generated, leading to increased entropy, or loss. When the leading edge is arc-shaped, shock wave S4 is generated upstream at a distance of x1*d* from the blade leading edge end 4. In the zone surrounded by shock wave S4, sonic lines a1 and b1, and the blade leading edge, the flow velocity is subsonic M3. When this subsonic zone is large, it is equivalent to a large loss, which suggests that loss can be reduced by decreasing the size of this zone. This subsonic zone M3 is generated when a flow curves at an angle in excess of the maximum angle δ max within which the flow can curve as it remains supersonic. The angle at which the flow curves virtually depends on the ratio of x1 to d1 in the leading edge.

Figure 7:
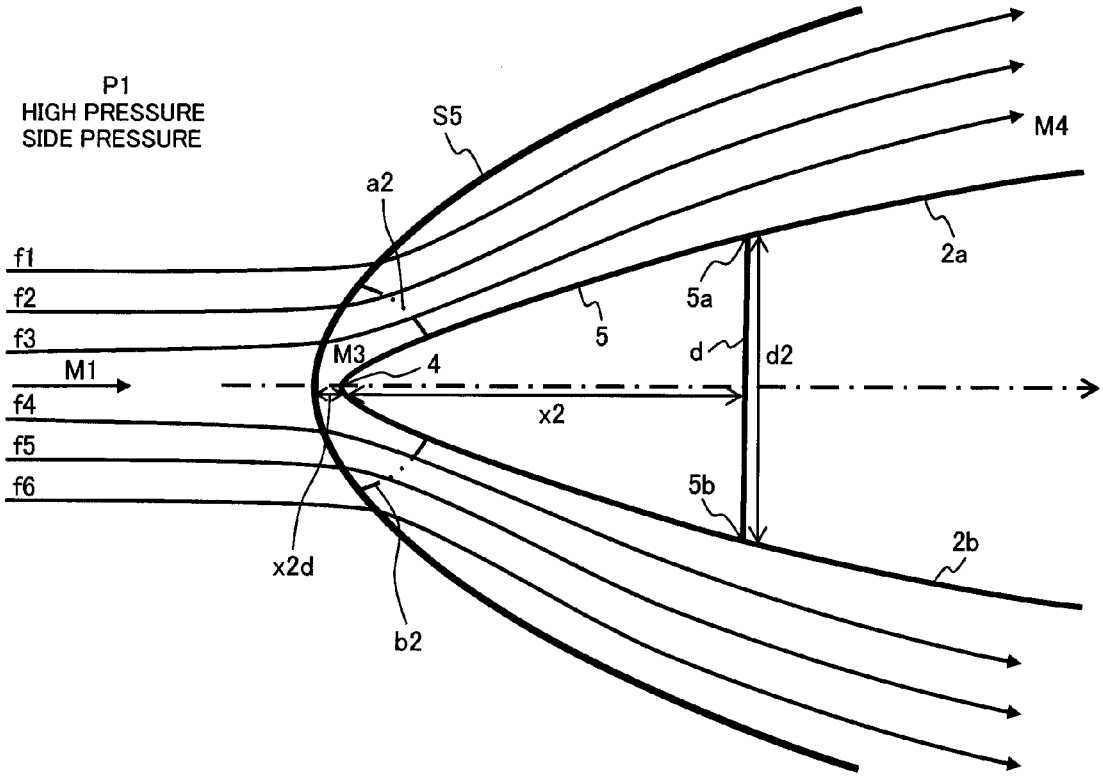
FIG. 7 illustrates the shape of the leading edge part of a turbine moving blade according to an embodiment of the present invention and the characteristics of a flow field in the case that a supersonic flow comes to the blade.
Figure 8:
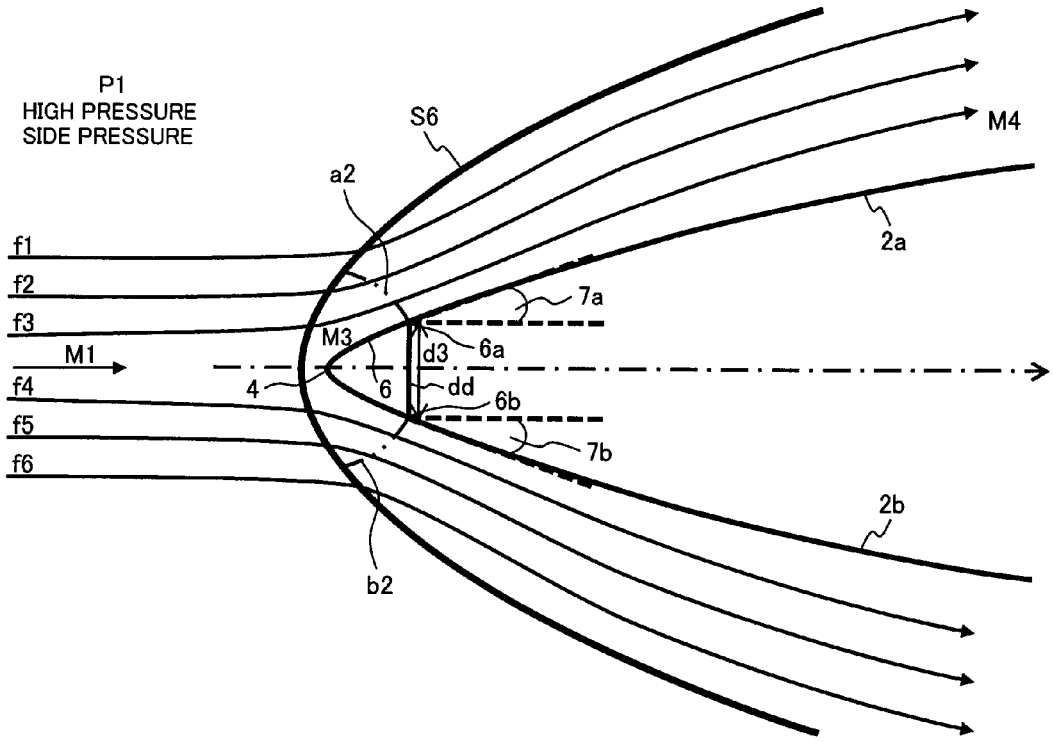
FIG. 8 illustrates the shape of the leading edge part of a turbine moving blade according to an embodiment of the present invention and the characteristics of a flow field in the case that a supersonic flow comes to the blade.

In an embodiment of the present invention, as illustrated in FIGS. 7 and 8, the leading edge shape of the supersonic turbine moving blade is so designed that the flows f1, f2, f3, f4, f5, and f6 curve at a much gentler angle than with the conventional arc-shaped leading edges to make the subsonic zone M3 smaller for the purpose of reducing loss due to shock wave S1 (S5, S6). The concrete shapes will be explained below referring to FIGS. 7 and 8.

FIG. 7 illustrates the features of a turbine moving blade according to an embodiment of the present invention. First, in this embodiment, the blade leading edge part 5 is formed by continuous curvature curves. In the case of the arc-shaped leading edge illustrated in FIG. 6, the curvature is discontinuous at the junction point 5*a* between the arc-shaped blade leading edge 5 and the negative pressure surface 2*a* and the junction point 5*b* between the arc-shaped blade leading edge 5 and the positive pressure surface 2*b*, so the blade leading edge can be identified as the arc-shaped portion (from 5*a* to 5*b*). On the other hand, in this embodiment, the blade leading edge part 5 is formed by continuous curvature curves and the curvature is continuous at 5*a* and 5*b*. Since the blade leading edge 5 in FIG. 7 is continuous with the negative pressure surface 2*a* at 5*a* and with the positive pressure surface 2*b* at 5*b*, it cannot be defined so clearly as the leading edge illustrated in FIG. 6.

In this embodiment, the blade leading edge 5 which begins at 5*a*, passes through the leading edge end 4 and ends at 5*b* is formed by continuous curvature curves so that distance x2 between line segment d (point where the blade thickness is one half of the blade maximum thickness on the blade upstream side) with length d2 as one half of the blade maximum thickness in a desired cross section (hereinafter a desired cross section within the range indicated in FIG. 3) and the leading edge end 4 is larger than length d2 (one half of the maximum blade thickness). Considering that the length d1 of the line segment d connecting 5*a* and 5*b* in the conventional arc-shaped blade leading edge is about one half of the blade maximum thickness, in this embodiment the blade leading edge shape is defined on the assumption that the blade leading edge is a portion between the blade surface points 5*a* and 5*b* which intersect with the line segment d with length d2 (one half of the maximum thickness). Therefore, length d2 does not strictly mean one half of the blade maximum thickness.

In this embodiment, since the blade leading edge part is formed by continuous curvature curves and x2 is larger than d2, flows f1, f2, f3, f4, f5, and f6 curve at a gentler angle and shock wave S5 is generated at a shorter distance x2*d* upstream from the blade leading edge end 4 than in the case of the arc-shaped leading edge. Thus the subsonic zone M3 surrounded by shock wave S5, sonic lines a2 and b2, and the blade leading edge 5 is smaller. If x2 is too large, the blade leading edge would be too thin, so the upper limit of x2 should be determined as appropriate from the viewpoint of blade leading edge strength.

FIG. 8 illustrates the features of the shape of the leading edge of a turbine moving blade according to an embodiment of the present invention. Like the embodiment described with reference to FIG. 7, this embodiment is also intended to ensure that flows f1, f2, f3, f4, f5, and f6 curve at a gentler angle and the subsonic zone M3 is smaller. In the embodiment illustrated in FIG. 8, the blade shape which enables flows f1, f2, f3, f4, f5, and f6 to curve at a gentler angle is designed from a different viewpoint from that in FIG. 7. In this embodiment as well, the blade leading edge part 6 is formed by continuous curvature curves.

In the embodiment illustrated in FIG. 8, the blade leading edge part 6 is formed so that angle 7*a* of the tangent of line segment dd (point where the blade thickness is one fifth of the blade maximum thickness on the blade upstream side) with length d3 as one fifth of the blade maximum thickness in a desired cross section at the blade negative pressure surface end 6*a* with respect to the entrance angle direction, and angle 7*b* of the tangent thereof at the blade positive pressure surface end 6*b* with respect to the entrance angle direction are both 20 degrees or less. The blade leading edge part 6 is formed by continuous curvature curves, in which it is connected to the negative pressure surface 2*a* at 6*a* and to the positive pressure surface 2*b* at 2*b* while curvature continuity is kept. Therefore, like the embodiment illustrated in FIG. 7, the blade leading edge is not so clearly defined as the blade leading edge illustrated in FIG. 6. In this embodiment, the blade leading edge is so shaped as to have a continuous curvature profile and the angles 7*a* and 7*b* at the line segment dd of the blade leading edge are both 20 degrees or less and thus sonic lines a2 and b2 are near to the leading edge end 4 or located on the line segment dd with length d3 which is about one fifth of the blade maximum thickness.

In this embodiment, due to this structure the size of the subsonic zone M3 is reduced to one half or less of that in the arc-shaped leading edge. In this embodiment, flows f1, f2, f3, f4, f5, and f6 curve only by 20 degrees except the vicinity of the leading edge end 4 and the intensity of sonic wave S6 caused by the supersonic flows curved by 20 degrees is low. Thus the subsonic zone M3 surrounded by shock wave S6, sonic lines a2 and b2, and the leading edge 6 is smaller, leading to reduced shock wave loss. Though it depends on the inflow velocity Mach number, if the Mach number is 1.3 or so, when the angles 7*a* and 7*b* are 10 degrees or so, the subsonic zone will be effectively reduced. However, though it depends on blade size, if the angles 7*a* and 7*b* are too small, the blade leading edge would be too thin, so the lower angle limit should be determined as appropriate from the viewpoint of blade leading edge strength, etc. and it is desirable that the angles be 10 degrees or more.

Next, the blade surface curvature distribution of a turbine moving blade in the embodiments of the present invention will be described referring to FIGS. 9 to 14.

Figure 9:
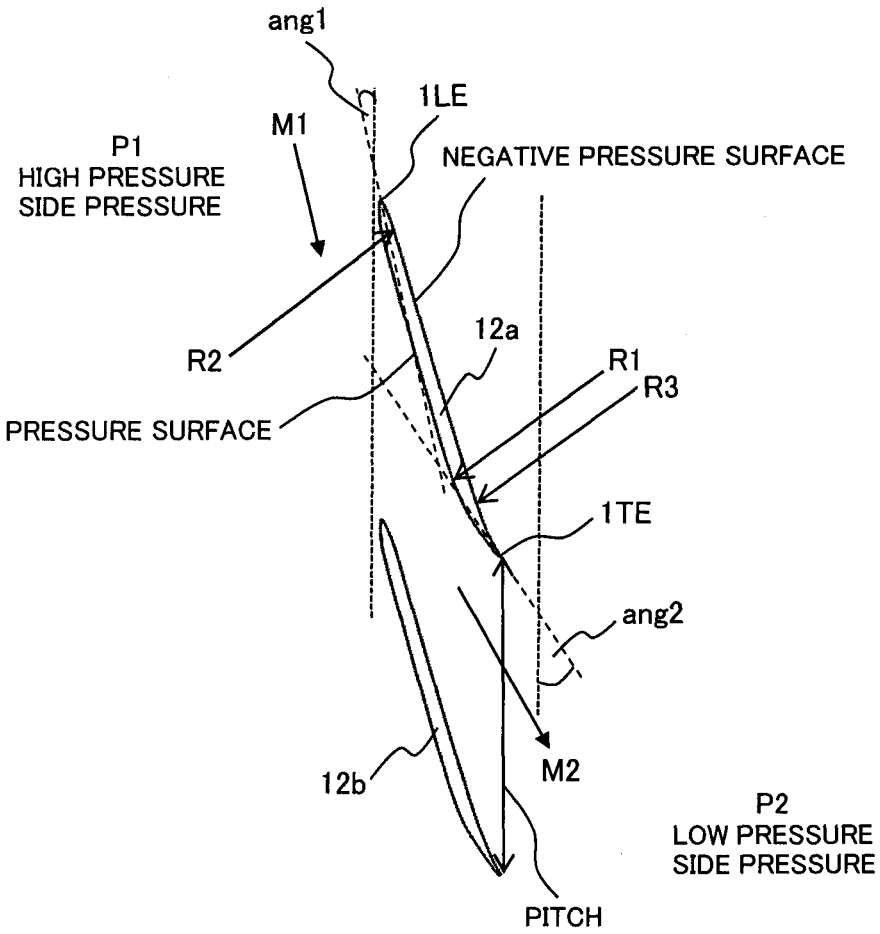
FIG. 9 illustrates the definition of positive and negative blade surface curvatures in a turbine moving blade according to an embodiment of the present invention.

FIG. 9 illustrates the definition of positive and negative blade surface curvatures in the turbine moving blade shape according to an embodiment of the present invention. A blade surface curvature is defined as positive when the curvature center is in the blade inner direction. In FIG. 9, as for a negative pressure surface, if it is convex, its curvature is defined as positive, while as for a pressure surface, if it is convex, its curvature is defined as positive. In the turbine moving blade according to an embodiment of the present invention, R1 and R2 are positive and R3 is negative.

Figure 10:
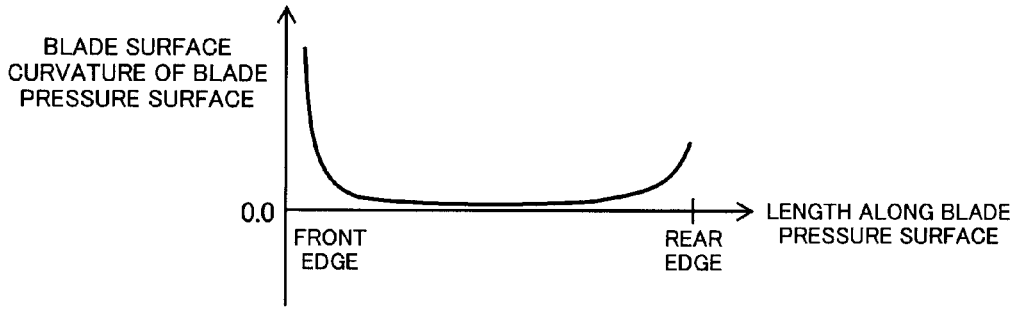
FIG. 10 illustrates the characteristics of blade pressure surface curvature distribution in a turbine moving blade according to an embodiment of the present invention.

FIG. 10 illustrates the blade surface curvature distribution of the blade pressure surface of the turbine moving blade according to an embodiment of the present invention, in which the horizontal axis represents curve length along the blade pressure surface. In an ordinary turbine blade, the blade exit angle is inclined in the circumferential direction with respect to the blade entrance angle and the blade surface curvature of the blade pressure surface is negative on the blade trailing edge side. By contrast, in this embodiment, the blade surface curvature of the blade pressure surface (R1 in FIG. 9) at any point is nonnegative, namely positive, or zero. As illustrated in FIG. 5 or FIG. 9, the area of the flow passage formed between blades facing each other increases toward the downstream side so that a flow can be accelerated smoothly in the passage from the point of entrance angle ang1 to the point of exit angle ang2. As a consequence, shock wave S2 at the trailing edge as illustrated in FIG. 4 which is caused by the blade pressure surface is weakened.

Figure 11:
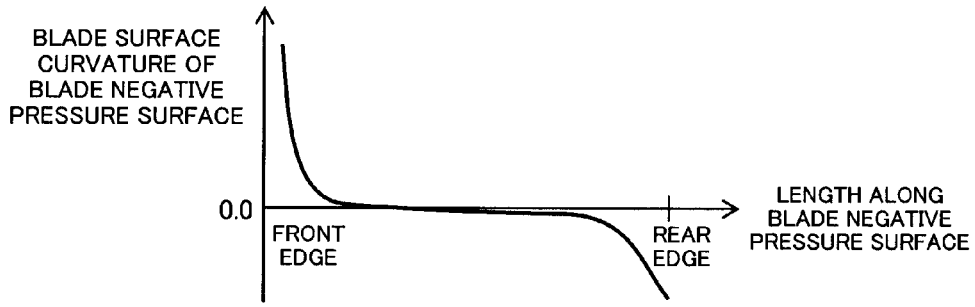
FIG. 11 illustrates the characteristics of blade negative pressure surface curvature distribution in a turbine moving blade according to an embodiment of the present invention.

FIG. 11 illustrates the blade surface curvature distribution of the blade negative pressure surface of the turbine moving blade according to an embodiment of the present invention, in which the horizontal axis represents curve length along the blade negative pressure surface. In an ordinary turbine blade, the blade exit angle is inclined in the circumferential direction with respect to the blade entrance angle and the blade surface curvature of the blade negative pressure surface is also positive on the downstream side (blade trailing edge). By contrast, in this embodiment, the blade surface curvature of the blade negative pressure surface is positive on the upstream side (R2 in FIG. 9) including the leading edge and negative on the downstream side (R3 in FIG. 9). This means that there exists an inflexion point midway where the curvature is zero. As illustrated in FIG. 5 or FIG. 9, the area of the flow passage formed between the blades facing each other increases toward the downstream side so that a flow can be accelerated smoothly in the passage from the point of entrance angle ang1 to the point of exit angle ang2. As a consequence, shock wave S3 at the trailing edge as illustrated in FIG. 4 which is caused by the blade negative pressure surface is weakened.

Figure 12:
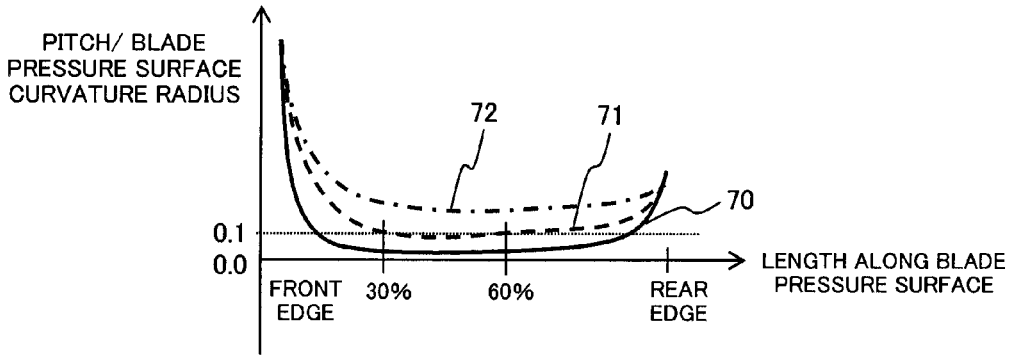
FIG. 12 illustrates details of blade pressure surface curvature distribution in a turbine moving blade according to an embodiment of the present invention.

FIG. 12 illustrates details of the blade surface curvature distribution of the blade pressure surface of the turbine moving blade according to an embodiment of the present invention. In the graph, the horizontal axis represents curve length along the blade pressure surface and the vertical axis represents dimensionless blade pressure surface curvature calculated by dividing the pitch as the distance between the blades in the circumferential direction by the curvature radius as the reciprocal of blade pressure surface curvature (it should be pitch multiplied by blade pressure surface curvature but in order to clearly show that it is a dimensionless blade pressure surface curvature, here it is expressed as pitch divided by blade pressure surface curvature radius). In the 30% to 60% portion of the entire curve length along the blade pressure surface, the curvature value should be 0.0 or more and less than 0.1. More ideally it should be a curvature distribution as indicated by curve 70 in the graph of FIG. 12 and at least a curvature distribution indicated by curve 71 in the graph.

Figure 13:
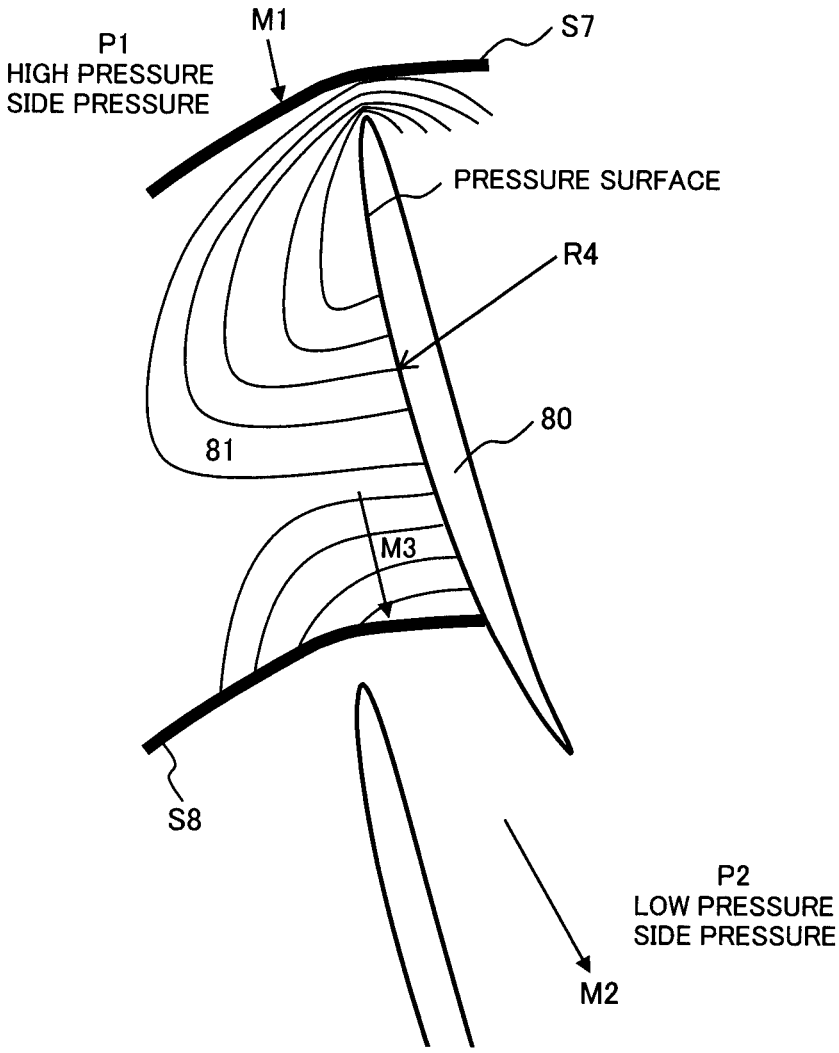
FIG. 13 illustrates the characteristics of a flow field in a turbine moving blade according to the present invention in which the curvature value of the blade ventral surface (pressure surface) is large.

The reason is explained below referring to FIGS. 13 and 14. FIG. 13 illustrates the characteristics of a flow field in the turbine moving blade 80 in which the dimensionless blade pressure surface curvature exceeds 0.1 even in the 30% to 60% portion of the length along the blade surface as indicated by curve 72 in FIG. 12. Due to the large curvature R4 in excess of positive value 0.1, an expansion wave 81 which accelerates the flow is generated on the blade pressure surface. This expansion wave 81 accelerates supersonic flow M1 and turns it into supersonic flow M3. For this reason, shock wave S8 generated on the upstream of the blade leading edge (shock wave S1 in FIG. 4) is intensified and loss is increased.

Figure 14:
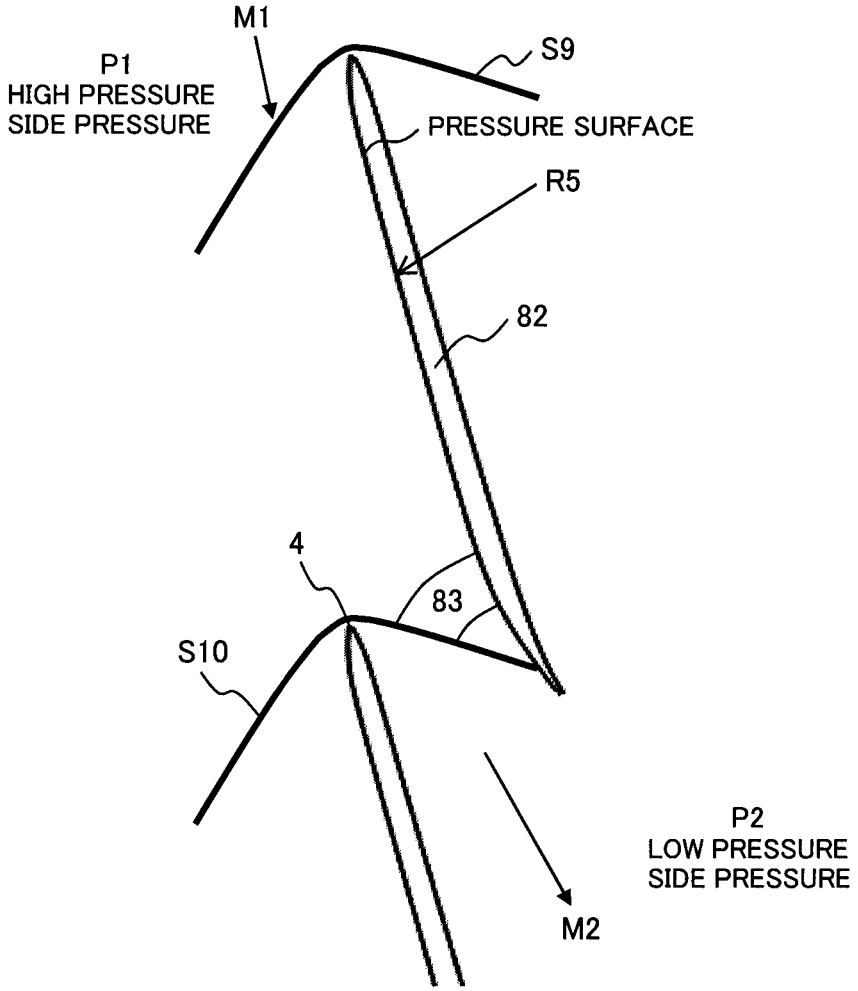
FIG. 14 illustrates the characteristics of a flow field in a turbine moving blade according to an embodiment of the present invention.

FIG. 14 illustrates the characteristics of a flow field in the turbine moving blade according to an embodiment of the present invention. In the turbine moving blade 82 illustrated in FIG. 14, the dimensionless blade pressure surface curvature is smaller than 0.1 in the 30% to 60% portion of the length along the blade surface as indicated by curve 70 or 71 illustrated in FIG. 12. Due to the small blade pressure surface curvature R5, an expansion wave is not generated on the blade pressure surface and supersonic inflow M1 is not accelerated and shock wave S10 (shock wave S1 in FIG. 4) is generated with the smallest Mach number on the upstream of the blade leading edge. Therefore, shock wave loss is small. The flow is bent and accelerated downstream of the 60% point of the curve length along the blade pressure surface where the flow passage between the blades is formed. Although expansion wave 83 is generated there, it is downstream of the blade leading edge end 4, so it only interferes with an oblique shock wave in the flow passage between the blades. Unlike a normal shock wave on the upstream of the blade leading edge, on the downstream of the oblique shock wave in the flow passage between the blades, the flow can be kept supersonic, so no serious loss occurs.

In addition, during a supersonic inflow, the inflow angle and inflow Mach number are not independent of each other. The relation between inflow angle and inflow Mach number, which is called "unique incidence relation," depends on blade shape. Therefore, it is desirable that the shape of a supersonic blade which receives a supersonic flow should meet both the inflow angle and inflow Mach number in the velocity triangle which are determined in the upstream design phase to prevent additional loss due to a mismatch between velocity triangle and blade. Concretely, it is desirable that the dimensionless blade surface curvature be smaller than 0.1 in the 30% to 60% portion of the length along the blade pressure surface and the average angle of the surface be close to the inflow angle (basically equal to the blade entrance angle ang1) (preferably substantially equal). Consequently, expansion wave from the blade pressure surface is suppressed and the unique incidence relation is satisfied, so additional loss due to a mismatch between velocity triangle and blade can be prevented.

Figure 15:
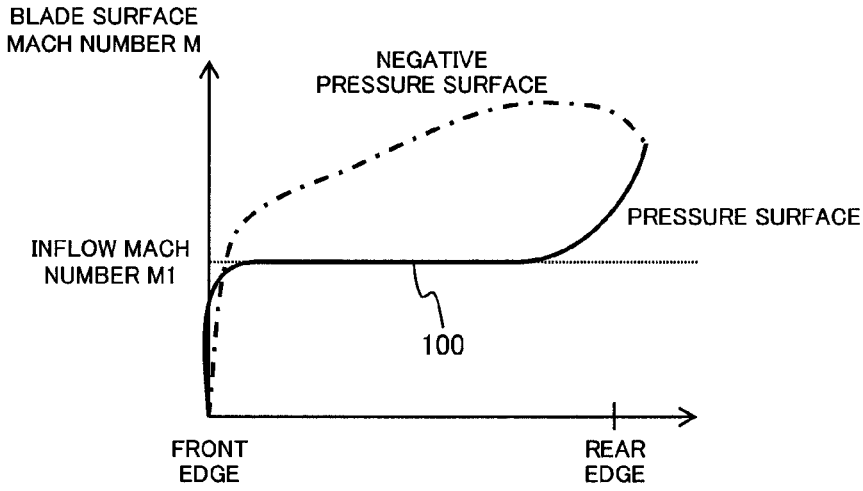
FIG. 15 illustrates the characteristics of blade surface Mach number distribution in a turbine moving blade according to an embodiment of the present invention.

FIG. 15 illustrates distribution of blade surface Mach number Mb when the dimensionless blade surface curvature is smaller than 0.1 in the 30% to 60% portion of the length along the blade pressure surface and the average angle of the surface is equal to the inflow angle. The blade surface Mach number Mb is calculated in accordance with Equation (2), in which p, P0, and γ represent blade surface pressure, entrance stagnation point pressure, and specific heat ratio, respectively:

Equation 2

$$Mb = \sqrt{\frac{2}{\gamma - 1}\left\{\left(\frac{P0}{P}\right)^{\frac{\gamma-1}{\gamma}} - 1\right\}} \tag{2}$$

The graph illustrates that the Mach number of the blade pressure surface portion indicated by 100 is equal to the inflow Mach number and its value is constant. Therefore, no excessive expansion wave is generated.

Figure 16:
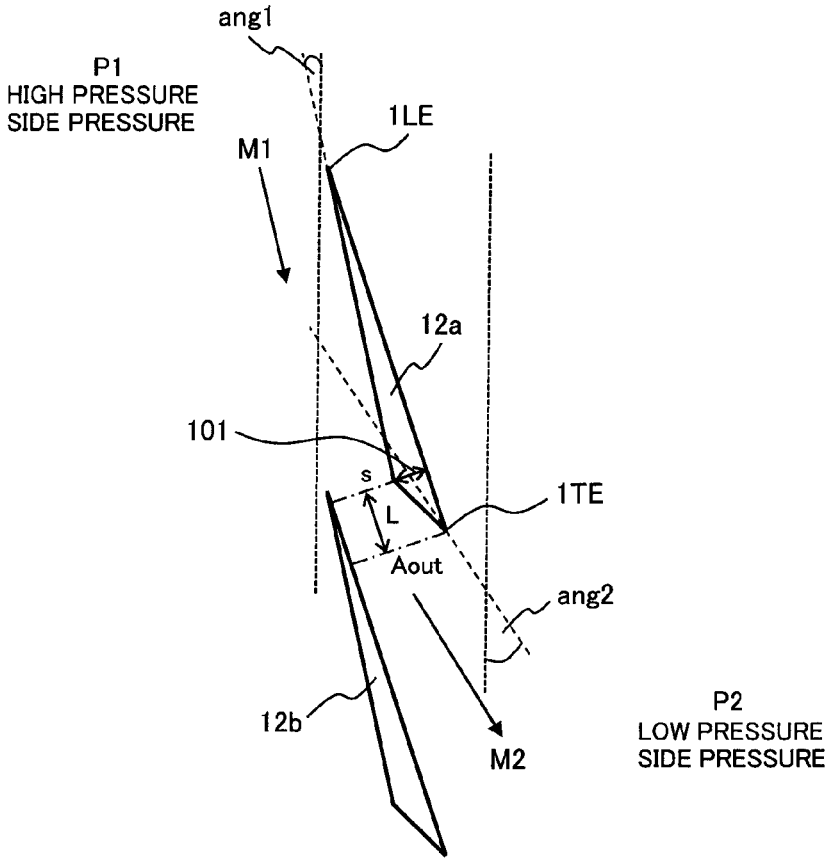
FIG. 16 illustrates the features of the shape of a turbine moving blade according to an embodiment of the present invention.

The features of the supersonic blade shapes according to the above embodiments of the present invention are summarized as illustrated in FIG. 16.

(1) The blade leading edge of the turbine blade is formed by continuous curvature curves and the distance between point where the blade thickness is one half of the blade maximum thickness on the blade upstream side and the leading edge end is larger than one half of the blade maximum thickness (FIG. 7), or the blade leading edge of the turbine blade is formed by continuous curvature curves and the angles of the blade negative pressure surface and blade pressure surface with respect to the entrance angle direction at the point where the blade thickness is one fifth of the blade maximum thickness on the blade upstream side are both 20 degrees or less (FIG. 8).

(2) When a blade surface curvature with the curvature center in the blade inner direction is defined as positive, the curvature of the blade pressure surface is positive or zero from the leading edge end to the trailing edge end (FIG. 10).

(3) The curvature of the blade negative pressure surface is positive on the upstream side and negative on the downstream side and there exists an inflexion point midway where the curvature is zero (FIG. 11).

(4) The dimensionless curvature of the blade pressure surface calculated by dividing the pitch as the distance between the blades in the circumferential direction by the curvature radius as the reciprocal of blade pressure surface curvature is smaller than 0.1 in the 30% to 60% portion of the distance along the blade pressure surface (FIGS. 12 and 14). In this case, preferably the average angle of the blade pressure surface should be close to the inflow angle (more preferably substantially equal to the inflow angle).

(5) The flow passage between the moving blades is an expanded flow passage with a throat as an entrance (FIG. 5). When the expanded flow passage with a throat as an entrance is formed, preferably the blade exit angle ang2 should be larger than the theoretical outflow angle ang2*t*. In order to form an expanded passage with a throat as an entrance and provide another feature, for example, the above feature (4), the blade maximum thickness point 101 should be nearer to the blade trailing edge 1TE than to the blade leading edge 1LE.

As explained so far, a turbine blade which has any of the various features of the embodiments of the present invention can weaken the intensity of shock wave and thereby prevent an increase in loss when the inflow and outflow velocities are both supersonic.

The present invention is not limited to the above embodiments and may be embodied in other various forms. Although the above embodiments have been described in detail for better understanding of the invention, the invention is not limited to an embodiment which includes all the constituent elements described above. Some constituent elements of an embodiment may be replaced by constituent elements of another embodiment or constituent elements of an embodiment may be added to the constituent elements of another embodiment. Also, addition, deletion or replacement of a constituent element may be made on some part of the constitution of an embodiment.

Particularly in the present invention, the features of some of the embodiments may be combined to weaken shock wave and prevent an increase in loss more effectively. For example, the features illustrated in FIGS. 7 and 8 may be combined with the feature illustrated in FIG. 12 (FIG. 14) to suppress shock wave on the upstream side more effectively. Also, the features illustrated in FIGS. 10 and 11 may be combined with the feature illustrated in FIG. 12 (FIG. 14) to suppress shock wave on the downstream side more effectively.

The foregoing explanation of the embodiments assumes that the invention is applied to the final turbine stage; however, the invention may be applied to a stage previous to the final stage. If both the inflow and outflow velocities are supersonic only in the final stage, it is preferable that the invention be applied only to the final stage.

The invention claimed is:

1. A turbine moving blade, which expands a flow in a flow passage formed between neighboring turbine moving blades with a high pressure area as an upstream side and a low pressure area as a downstream side, an airfoil of the turbine moving blade is configured such that an exit angle of the blade is oriented in an axial direction of a turbine with respect to an entrance angle of the blade; and when a blade surface curvature with a curvature center in an inner direction of the blade is defined as positive, a blade pressure surface curvature is positive or zero from a leading edge end to a trailing edge end.

2. The turbine moving blade according to claim 1, wherein a blade negative pressure surface curvature is positive on the upstream side and negative on the downstream side with an inflexion point midway where the curvature is zero.

3. An axial-flow turbine comprising a plurality of turbine stages each including a stationary blade and a moving blade, wherein a moving blade according to claim 1 is used in a final stage.

4. A turbine moving blade, which expands a flow in a flow passage formed between neighboring turbine moving blades with a high pressure area as an upstream side and a low pressure area as a downstream side, an airfoil of the turbine moving blade is configured such that an exit angle of the blade is oriented in an axial direction of a turbine with respect to an entrance angle of the blade; and when a blade surface curvature with a curvature center in an inner direction of the blade is defined as positive, a blade negative pressure surface curvature is positive on the upstream side and negative on the downstream side with an inflexion point midway where the curvature is zero.

5. A turbine moving blade, which expands a flow in a flow passage formed between neighboring turbine moving blades with a high pressure area as an upstream side and a low pressure area as a downstream side, an airfoil of the turbine moving blade is configured such that an exit angle of the blade is oriented in an axial direction of a turbine with respect to an entrance angle of the blade; and when a blade surface curvature with a curvature center in an inner direction of the blade is defined as positive, a dimensionless blade pressure surface curvature calculated by dividing a pitch as a distance between blades in a circumferential direction by a curvature radius as a reciprocal of blade pressure surface curvature is larger than 0.0 and smaller than 0.1 in a 30% to 60% portion of an entire length in a distance along a blade pressure surface.

6. The turbine moving blade according to claim 5, wherein a blade negative pressure surface curvature is positive on the upstream side and negative on the downstream side with an inflexion point midway where the curvature is zero.

7. The turbine moving blade according to claim 5, wherein an average angle of the blade pressure surface is substantially equal to an inflow angle.

8. The turbine moving blade according to claim 7, wherein a maximum thickness point of the blade is nearer to a blade trailing edge than to a blade leading edge and the flow passage between blades is an expanded flow passage with a throat as an entrance.

9. A turbine moving blade, which expands a flow in a flow passage formed between neighboring turbine moving blades with a high pressure area as an upstream side and a low pressure area as a downstream side, an airfoil of the turbine moving blade is configured such that an exit angle of the blade is oriented in an axial direction of a turbine with respect to an entrance angle of the blade; a blade leading edge part is formed by continuous curvature curves; and a distance between a point with one half of a maximum thickness of the blade on the upstream side of the blade and an end of the blade leading edge is larger than one half of the maximum thickness of the blade.

10. The turbine moving blade according to claim 9, wherein when a blade surface curvature with a curvature center in an inner direction of the blade is defined as positive, a blade pressure surface curvature is positive or zero from a leading edge end to a trailing edge end.

11. The turbine moving blade according to claim 9, wherein when a blade surface curvature with a curvature center in an inner direction of the blade is defined as positive, a dimensionless blade pressure surface curvature calculated by dividing a pitch as a distance between blades in a circumferential direction by a curvature radius as a reciprocal of blade pressure surface curvature is larger than 0.0 and smaller than 0.1 in a 30% to 60% portion of an entire length in a distance along the blade pressure surface.

12. The turbine moving blade according to claim 9, wherein when a blade surface curvature with a curvature center in an inner direction of the blade is defined as positive, a blade pressure surface curvature is positive or zero from a leading edge end to a trailing edge end; and wherein a blade negative pressure surface curvature is positive on the upstream side and negative on the downstream side with an inflexion point midway where the curvature is zero.

13. The turbine moving blade according to claim 9, wherein when a blade surface curvature with a curvature center in an inner direction of the blade is defined as positive, a dimensionless blade pressure surface curvature calculated by dividing a pitch as a distance between blades in a circumferential direction by a curvature radius as a reciprocal of blade pressure surface curvature is larger than 0.0 and smaller than 0.1 in a 30% to 60% portion of an entire length in a distance along the blade pressure surface; and wherein a blade negative pressure surface curvature is positive on the upstream side and negative on the downstream side with an inflexion point midway where the curvature is zero.

14. A turbine moving blade, which expands a flow in a flow passage formed between neighboring turbine moving blades with a high pressure area as an upstream side and a low pressure area as a downstream side, an airfoil of the turbine moving blade is configured such that an exit angle of the blade is oriented in an axial direction of a turbine with respect to an entrance angle of the blade; a blade leading edge part is formed by continuous curvature curves; and an angle of a blade negative pressure surface tangent with respect to an entrance angle direction and an angle of a blade pressure surface tangent with respect to the entrance angle direction at a point with one fifth of a maximum thickness of the blade on the upstream side of the blade are both 20 degrees or less.

15. A turbine moving blade, which expands a flow in a flow passage formed between neighboring turbine moving blades with a high pressure area as an upstream side and a low pressure area as a downstream side, an airfoil of the turbine moving blade is configured such that an exit angle of the blade is oriented in an axial direction of a turbine with respect to an entrance angle of the blade; and the exit angle of the blade is larger than a theoretical outflow angle.

16. A turbine moving blade, which expands a flow in a flow passage formed between neighboring turbine moving blades with a high pressure area as an upstream side and a low pressure area as a downstream side, an airfoil of the turbine moving blade is configured such that an exit angle of the blade is oriented in an axial direction of a turbine with respect to an entrance angle of the blade; and a point with a maximum thickness of the blade is nearer to a blade trailing edge than to a blade leading edge and a flow passage between blades is an expanded flow passage with a throat as an entrance.

17. A supersonic turbine moving blade, which expands a flow in a flow passage formed between neighboring moving blades with a high pressure area as an upstream side and a low pressure area as a downstream side and both an inflow Mach number and an outflow Mach number exceed 1.0 to make a supersonic flow, an airfoil of the supersonic moving blade is configured such that when a blade surface curvature with a curvature center in an inner direction of the blade is defined as positive, a blade pressure surface curvature is positive or zero from a leading edge end to a trailing edge end.

18. The supersonic turbine moving blade according to claim 17, wherein a blade negative pressure surface curvature is positive on the upstream side and negative on the downstream side with an inflexion point midway where the curvature is zero.

19. A supersonic turbine moving blade, which expands a flow in a flow passage formed between neighboring moving blades with a high pressure area as an upstream side and a low pressure area as a downstream side and both an inflow Mach number and an outflow Mach number exceed 1.0 to make a supersonic flow, an airfoil of the supersonic moving blade is configured such that when a blade surface curvature with a curvature center in an inner direction of the blade is defined as positive, a blade negative pressure surface curvature is positive on the upstream side and negative on the downstream side with an inflexion point midway where the curvature is zero.

20. A supersonic turbine moving blade, which expands a flow in a flow passage formed between neighboring moving blades with a high pressure area as an upstream side and a low pressure area as a downstream side and both an inflow Mach number and an outflow Mach number exceed 1.0 to make a supersonic flow, an airfoil of the supersonic moving blade is configured such that when a blade surface curvature with a curvature center in an inner direction of the blade is defined as positive, a dimensionless blade pressure surface curvature calculated by dividing a pitch as a distance between blades in a circumferential direction by a curvature radius as a reciprocal of blade pressure surface curvature is larger than 0.0 and smaller than 0.1 in a 30% to 60% portion of an entire length in a distance along the blade pressure surface.

21. The supersonic turbine moving blade according to claim 20, wherein a blade negative pressure surface curvature is positive on the upstream side and negative on the downstream side with an inflexion point midway where the curvature is zero.

22. The supersonic turbine moving blade according to claim 20, wherein an average angle of the blade pressure surface is substantially equal to an inflow angle.

23. The supersonic turbine moving blade according to claim 22, wherein a maximum thickness point of the blade is nearer to a blade trailing edge than to a blade leading edge and a flow passage between blades is an expanded flow passage with a throat as an entrance.

24. A supersonic turbine moving blade, which expands a flow in a flow passage formed between neighboring moving blades with a high pressure area as an upstream side and a low pressure area as a downstream side and both an inflow Mach number and an outflow Mach number exceed 1.0 to make a supersonic flow, an airfoil of the supersonic moving blade is configured such that a blade leading edge part is formed by continuous curvature curves; and a distance between a point with one half of a maximum thickness of the blade on the upstream side of the blade and an end of the blade leading edge is larger than one half of the maximum thickness of the blade.

25. The supersonic turbine moving blade according to claim 24, wherein when a blade surface curvature with a curvature center in an inner direction of the blade is defined as positive, a blade pressure surface curvature is positive or zero from a leading edge end to a trailing edge end.

26. The supersonic turbine moving blade according to claim 24, wherein when a blade surface curvature with a curvature center in an inner direction of the blade is defined as positive, a dimensionless blade pressure surface curvature calculated by dividing a pitch as a distance between blades in a circumferential direction by a curvature radius as a reciprocal of blade pressure surface curvature is larger than 0.0 and smaller than 0.1 in a 30% to 60% portion of an entire length in a distance along the blade pressure surface.

27. The supersonic turbine moving blade according to claim 24, wherein when a blade surface curvature with a curvature center in an inner direction of the blade is defined as positive, a blade pressure surface curvature is positive or zero from a leading edge end to a trailing edge end; and wherein a blade negative pressure surface curvature is positive on the upstream side and negative on the downstream side with an inflexion point midway where the curvature is zero.

28. The supersonic turbine moving blade according to claim 24, wherein when a blade surface curvature with a curvature center in an inner direction of the blade is defined as positive, a dimensionless blade pressure surface curvature calculated by dividing a pitch as a distance between blades in a circumferential direction by a curvature radius as a reciprocal of blade pressure surface curvature is larger than 0.0 and smaller than 0.1 in a 30% to 60% portion of an entire length in a distance along the blade pressure surface; and wherein a blade negative pressure surface curvature is positive on the upstream side and negative on the downstream side with an inflexion point midway where the curvature is zero.

29. A supersonic turbine moving blade, which expands a flow in a flow passage formed between neighboring moving blades with a high pressure area as an upstream side and a low pressure area as a downstream side and both an inflow Mach number and an outflow Mach number exceed 1.0 to make a supersonic flow, an airfoil of the supersonic moving blade is configured such that a blade leading edge part is formed by continuous curvature curves; and an angle of a blade negative pressure surface tangent with respect to an entrance angle direction and an angle of a blade pressure surface tangent with respect to the entrance angle direction at a point with one fifth of a maximum thickness of the blade on the upstream side of the blade are both 20 degrees or less.

30. A supersonic turbine moving blade, which expands a flow in a flow passage formed between neighboring moving blades with a high pressure area as an upstream side and a low pressure area as a downstream side and both an inflow Mach number and an outflow Mach number exceed 1.0 to make a supersonic flow, an airfoil of the supersonic moving blade is configured such that an exit angle of the blade is larger than a theoretical outflow angle.

31. A supersonic moving blade, which expands a flow in a flow passage formed between neighboring moving blades with a high pressure area as an upstream side and a low pressure area as a downstream side and both an inflow Mach number and an outflow Mach number exceed 1.0 to make a supersonic flow, an airfoil of the supersonic moving blade is configured such that a point with a maximum thickness of the blade is nearer to a blade trailing edge than to a blade leading edge and a flow passage between blades is an expanded flow passage with a throat as an entrance.

* * * * *